US011499124B2

(12) United States Patent
Ho et al.

(10) Patent No.: US 11,499,124 B2
(45) Date of Patent: Nov. 15, 2022

(54) SOLID GRANULES USED FOR CLEANING AGENTS

(71) Applicant: YFY Consumer Products, Co., Dover, DE (US)

(72) Inventors: Yi-Da Ho, Taipei (TW); Hsien-Ming Kwo, Taipei (TW); Hsing-Nan Chen, Taipei (TW); Shiu-Chih Tsai, Taipei (TW)

(73) Assignee: YFY Consumer Products, Co., Dover, DE (US)

( * ) Notice: Subject to any disclaimer, the term of this patent is extended or adjusted under 35 U.S.C. 154(b) by 0 days.

(21) Appl. No.: 16/930,009

(22) Filed: Jul. 15, 2020

(65) Prior Publication Data

US 2021/0284937 A1 Sep. 16, 2021

Related U.S. Application Data

(60) Provisional application No. 62/989,051, filed on Mar. 13, 2020.

(51) Int. Cl.
*C11D 17/00* (2006.01)
*C11D 1/28* (2006.01)
(Continued)

(52) U.S. Cl.
CPC ..... *C11D 11/0082* (2013.01); *C11D 1/143* (2013.01); *C11D 1/146* (2013.01);
(Continued)

(58) Field of Classification Search
None
See application file for complete search history.

(56) References Cited

U.S. PATENT DOCUMENTS 4,678,594 A 7/1987 Parfomak et al.
5,318,733 A 6/1994 Carduck et al.
(Continued)

FOREIGN PATENT DOCUMENTS

CN 101955855 A 1/2011
CN 101985323 A 3/2011
(Continued)

OTHER PUBLICATIONS

International Search Report and Written Opinion of the International Searching Authority; Application No. PCT/US21/19423; Completed: Apr. 21, 2021; dated May 19, 2021; 11 Pages.
(Continued)

*Primary Examiner* — Lorna M Douyon
(74) *Attorney, Agent, or Firm* — Whitmyer IP Group LLC

(57) ABSTRACT

A solid granule or granular material used for cleaning agents includes an anionic surfactant component and a molding agent. The anionic surfactant component includes an anionic sulfonate surfactant and an anionic fatty alcohol-based sulfate surfactant. Based on the total amount of the cleaning granule being 100 wt %, the combined amount of the sulfonate surfactant and the sulfate surfactant is between 15.0 wt % and 100 wt %. The amount of molding agent is 5.0 wt % or less. The ratio of the sulfonate surfactant to the sulfate surfactant is 0.20 to 0.75, inclusive. A cohesion of the solid granule is between 1000 g/mm and 4000 g/mm.

30 Claims, 6 Drawing Sheets

(51) Int. Cl.

| | |
|---|---|
| ***C11D 1/29*** | (2006.01) |
| ***C11D 3/10*** | (2006.01) |
| ***C11D 3/22*** | (2006.01) |
| ***C11D 3/386*** | (2006.01) |
| ***C11D 11/00*** | (2006.01) |
| ***C11D 1/14*** | (2006.01) |
| ***C11D 3/20*** | (2006.01) |
| ***C11D 3/04*** | (2006.01) |

(52) U.S. Cl.
CPC ..... *C11D 1/28* (2013.01); *C11D 3/046* (2013.01); *C11D 3/10* (2013.01); *C11D 3/2065* (2013.01); *C11D 3/2082* (2013.01); *C11D 3/222* (2013.01); *C11D 3/38609* (2013.01); *C11D 3/38627* (2013.01); *C11D 3/38636* (2013.01); *C11D 3/38645* (2013.01); *C11D 11/0017* (2013.01); *C11D 11/0035* (2013.01); *C11D 11/0052* (2013.01); *C11D 17/0039* (2013.01)

(56) References Cited

U.S. PATENT DOCUMENTS

| | | | | |
|---|---|---|---|---|
| 5,431,857 | A * | 7/1995 | Capeci | C11D 1/37 510/352 |
| 5,527,489 | A | 6/1996 | Tadsen et al. | |
| 6,017,873 | A * | 1/2000 | Sikra | C11D 1/146 264/117 |
| 6,306,817 | B1 * | 10/2001 | Kott | C11D 1/22 510/535 |
| 6,376,454 | B1 * | 4/2002 | Eggersmann | C11D 3/124 510/312 |
| 6,635,610 | B1 | 10/2003 | Tatsuno et al. | |
| 6,673,766 | B1 * | 1/2004 | Hartshorn | C11D 1/22 510/315 |
| 7,186,678 | B2 | 3/2007 | Weuthen et al. | |
| 10,105,240 | B2 | 10/2018 | DeFelice et al. | |
| 10,272,139 | B2 | 4/2019 | Turzi | |
| 10,294,445 | B2 | 5/2019 | Brandt Sanz | |
| 10,550,357 | B2 | 2/2020 | Somerville Roberts et al. | |
| 2003/0040457 | A1 * | 2/2003 | Behler | C11D 17/06 510/421 |
| 2009/0215664 | A1 | 8/2009 | Raehse | |
| 2011/0082066 | A1 * | 4/2011 | Wrubbel | C11D 3/001 510/327 |
| 2016/0068784 | A1 | 3/2016 | Vinson et al. | |
| 2018/0200922 | A1 | 7/2018 | DeFelice et al. | |
| 2018/0201783 | A1 | 7/2018 | DeFelice et al. | |

FOREIGN PATENT DOCUMENTS

| | | | |
|---|---|---|---|
| CN | 103210072 | A | 7/2013 |
| EP | 2162522 | A1 | 3/2010 |
| JP | 2008050411 | A | 3/2008 |
| JP | 2012122067 | A | 6/2012 |
| TW | 236635 | B | 12/1994 |
| WO | 9400544 | A1 | 1/1994 |

OTHER PUBLICATIONS

International Preliminary Report on Patentability; Application No. PCT/US2021/019423; dated Dec. 13, 2021; 24 pages.
Taiwan First Office Action; Application No. 109125144; dated Apr. 16, 2021; 24 Pages.
Taiwan Second Office Action; Application No. 109125144; dated Aug. 9, 2021; 7 Pages.
Taiwan Notice of Allowance; Application No. 109125144; dated Oct. 12, 2021; 42 Pages.
Japanese Office Action; Application No. 2021-568719; dated Sep. 16, 2022; 9 pages.

* cited by examiner

| | | | | Inventive Examples | | | | | |
|---|---|---|---|---|---|---|---|---|---|
| | | | | 1 | 2 | 3 | 4 | 5 | 6 |
| Project | Ingredient | Classification | Specific Component | w/w% | | | | | |
| A | Anionic surfactant | alkyl ester sulfonate surfactant | secondary alkyl sulfonate and/or methyl ester sulfonate | 3.000 | 4.000 | 6.000 | 12.000 | 9.000 | 12.000 |
| B | Anionic surfactant | alkyl sulphate surfactant | sodium laureth sulfate | 15.000 | 16.000 | 19.000 | 16.000 | 21.000 | 23.000 |
| A/B Ratio | | | | 0.200 | 0.250 | 0.316 | 0.750 | 0.429 | 0.522 |
| A+B Total | | | | 18.000 | 20.000 | 25.000 | 28.000 | 30.000 | 35.000 |
| C | Molding agent | polyhydric alcohol | glycerin, sorbital, and/or propylene glycol | 5.000 | 4.000 | 3.500 | 3.000 | 3.000 | 2.500 |
| D | Disintegrant | | carboxymethyl cellulose, tartaric acid, and/or citric acid | 1.000 | | | | | |
| E | Irritating flavor agent or additive | | denatonium benzoate | 0.001 | | | | | |
| F | Fragrance | | orange oil | 0.500 | | | | | |
| G | Enzyme | enzyme | protease, lipase, cellulase, amylase, mannanase, and/or pectinase | 0.500 | | | | | |
| H | Builder | alkali agent | sodium bicarbonate | 20.000 | | | | | |
| I | | alkali agent | sodium sulfate | to 100 | | | | | |
| Characteristics | | Measurement Method | | | | | | | |
| Cohesiveness (g/mm) target 1000-4000 | | Take an appropriate powder weight of 70g and compress it with a force of 10kg for 30 sec. Compress and destroy the powder column to obtain cohesion. Consolidation Force: 10Kg Consolidation Time: 30sec Max Tracking Speed: 1.00 mm/sec | | 1879 | 2021 | 2231 | 3254 | 2875 | 3004 |
| Sphericity R2/R1 target 0.95-1.0 | | R1: the longest side of the particle R2: the shorted side of the particle The closer the ratio is to 1, the closer to the spherical shape. 100 averages | | 0.98 | 0.98 | 0.99 | 0.99 | 0.98 | 0.98 |
| Granule Average Size (the mold is 6mm) | | Take 100 measurements of particle diameters | | 6.01 | 6.00 | 6.01 | 6.00 | 6.00 | 6.01 |
| Granule Average Size (the mold is 20mm) | | Take 100 measurements of particle diameters | | 20.00 | 20.00 | 20.00 | 20.00 | 20.00 | 20.00 |
| Dissolution rate (min:sec) target is <6:00 | | 20g in 60L water @ 25°C with 500rpm | | 3:30 | 3:30 | 3:45 | 4:00 | 3:45 | 4:00 |
| Detergency improvement % | | Compared with washing powder | | 33% | 44% | 55% | 62% | 66% | 77% |

FIG. 6A

| | | | | Inventive Examples | | | | | |
|---|---|---|---|---|---|---|---|---|---|
| | | | | 7 | 8 | 9 | 10 | 11 | 12 |
| Project | Ingredient | Classification | Specific Component | w/w% | | | | | |
| A | Anionic surfactant | alkyl ester sulfonate surfactant | secondary alkyl sulfonate and/or methyl ester sulfonate | 15.000 | 12.000 | 18.000 | 21.000 | 18.000 | 10.000 |
| B | Anionic surfactant | alkyl sulphate surfactant | sodium laureth sulfate | 25.000 | 36.000 | 27.000 | 29.000 | 38.000 | 50.000 |
| A/B Ratio | | | | 0.600 | 0.333 | 0.667 | 0.724 | 0.474 | 0.200 |
| A+B Total | | | | 40.000 | 48.000 | 45.000 | 50.000 | 56.000 | 60.000 |
| C | Molding agent | polyhydric alcohol | glycerin, sorbital, and/or propylene glycol | 2.000 | 1.500 | 1.500 | 15.000 | 1.500 | 1.000 |
| D | Disintegrant | | carboxymethyl cellulose, tartaric acid, and/or citric acid | 1.000 | | | | | |
| E | Irritating flavor agent or additive | | denatonium benzoate | 0.001 | | | | | |
| F | Fragrance | | orange oil | 0.500 | | | | | |
| G | Enzyme | enzyme | protease, lipase, cellulase, amylase, mannanase, and/or pectinase | 0.500 | | | | | |
| H | Builder | alkali agent | sodium bicarbonate | 20.000 | | | | | |
| I | | alkali agent | sodium sulfate | to 100 | | | | | |
| Characteristics | | Measurement Method | | | | | | | |
| Cohesiveness (g/mm) target 1000-4000 | | Take an appropriate powder weight of 70g and compress it with a force of 10kg for 30 sec. Compress and destroy the powder column to obtain cohesion. Consolidation Force: 10Kg Consolidation Time: 30sec Max Tracking Speed: 1.00 mm/sec | | 3398 | 2709 | 3543 | 3669 | 3102 | 2501 |
| Sphericity R2/R1 target 0.95-1.0 | | R1: the longest side of the particle R2: the shorted side of the particle The closer the ratio is to 1, the closer to the spherical shape. 100 averages | | 0.95 | 0.93 | 0.95 | 0.93 | 0.9 | 0.9 |
| Granule Average Size (the mold is 6mm) | | Take 100 measurements of particle diameters | | 6.00 | 6.00 | 6.01 | 5.90 | 5.90 | 5.90 |
| Granule Average Size (the mold is 20mm) | | Take 100 measurements of particle diameters | | 20.30 | 19.70 | 19.80 | 19.80 | 19.50 | 19.60 |
| Dissolution rate (min:sec) target is <6:00 | | 20g in 60L water @ 25°C with 500rpm | | 4:15 | 4:30 | 4:45 | 5:00 | 5:30 | 5:45 |
| Detergency improvement % | | Compared with washing powder | | 88% | 106% | 99% | 110% | 123% | 132% |

FIG. 6B

| | | | | Inventive Examples | Comparative Studies | | | | |
|---|---|---|---|---|---|---|---|---|---|
| | | | | 13 | 1a | 1b | 1c | 4a | 13a |
| Project | Ingredient | Classification | Specific Component | w/w% | | | | | |
| A | Anionic surfactant | alkyl ester sulfonate surfactant | secondary alkyl sulfonate and/or methyl ester sulfonate | 20.000 | 2.000 | 2.000 | 2.000 | 13.000 | 20.000 |
| B | Anionic surfactant | alkyl sulphate surfactant | sodium laureth sulfate | 40.000 | 13.000 | 13.000 | 16.000 | 15.000 | 45.000 |
| A/B Ratio | | | | 0.500 | 0.154 | 0.154 | 0.125 | 0.867 | 0.444 |
| A+B Total | | | | 60.000 | 15.000 | 15.000 | 18.000 | 28.000 | 65.000 |
| C | Molding agent | polyhydric alcohol | glycerin, sorbital, and/or propylene glycol | 1.000 | 5.000 | 8.000 | 5.000 | 3.000 | 1.000 |
| D | Disintegrant | | carboxymethyl cellulose, tartaric acid, and/or citric acid | 1.000 | 1.000 | | | | |
| E | Irritating flavor agent or additive | | denatonium benzoate | 0.001 | 0.001 | | | | |
| F | Fragrance | | orange oil | 0.500 | 0.500 | | | | |
| G | Enzyme | enzyme | protease, lipase, cellulase, amylase, mannanase, and/or pectinase | 0.500 | 0.500 | | | | |
| H | Builder | alkali agent | sodium bicarbonate | 20.000 | 20.000 | | | | |
| I | | alkali agent | sodium sulfate | to 100 | to 100 | | | | |
| Characteristics | | Measurement Method | | | | | | | |
| Cohesiveness (g/mm) target 1000~4000 | | Take an appropriate powder weight of 70g and compress it with a force of 10kg for 30 sec. Compress and destroy the powder column to obtain cohesion. Consolidation Force: 10Kg Consolidation Time: 30sec Max Tracking Speed: 1.00 mm/sec | | 3707 | 988 | 1500 | 992 | 5009 | 4804 |
| Sphericity R2/R1 target 0.95-1.0 | | R1: the longest side of the particle R2: the shorted side of the particle The closer the ratio is to 1, the closer to the spherical shape. 100 averages | | 0.9 | 0.3 | >5 | 0.7 | 0.99 | >5 |
| Granule Average Size (the mold is 6mm) | | Take 100 measurements of particle diameters | | 5.90 | <3 | NA | NA | 6.00 | NA |
| Granule Average Size (the mold is 20mm) | | Take 100 measurements of particle diameters | | 19.50 | < 10 | NA | NA | 20.00 | NA |
| Dissolution rate (min:sec) target is <6:00 | | 20g in 60L water @ 25°C with 500rpm | | 5:45 | NA | NA | NA | 7:00 | >8:00 |
| Detergency improvement % | | Compared with washing powder | | 132% | NA | NA | NA | NA | NA |

FIG. 6C

SOLID GRANULES USED FOR CLEANING AGENTS

TECHNICAL FIELD

The present teachings relate generally to cleaning agents, and more specifically to a solid granule used for a cleaning agent, such as a detergent.

BACKGROUND

It is known that various cleaning applications, such as laundry, warewashing, and surface cleaning, utilize powders that are manually scooped into water and dissolved. The resulting cleaning solution is applied to the surface of the article being cleaned. Such powders should exhibit good flow properties, good dispensing, and good dissolving capability in wash water.

However, conventional powder cleaning products have problems related to easy absorption of moisture during storage, which leads to clumping of granules. The resulting agglomeration negatively impacts the ability of the cleaning products to dissolve in water. Further, certain ingredients/components that are included in the cleaning products for providing improved cleaning performance (e.g., surfactants) also lead to agglomeration. Increasing the content of surfactants in order to achieve better cleaning characteristics causes the negative effect of increased agglomeration. This in turn means that the cleaning product may leave fabric or machine residues since the granules do not completely dissolve in water. Also, the problem of agglomeration may impede the surfactants from being properly delivered to the wash and can entrap other ingredients of the granular cleaning product, thereby rendering them ineffective in the wash.

For example, U.S. Pat. No. 5,318,733 discloses a laundry washing compressed granule. The granule includes a plasticizer or a lubricant. The plasticizer and/or lubricant is an anionic surfactant, a nonionic surfactant, a water-soluble polymer, a water-emulsifiable polymer, or a water-dispersible polymer. The individual granules have a particle diameter of 0.5 mm to 5 mm and a density of 700 g/L to 1000 g/L.

Chinese Patent No. 103210072 discloses a spherical toilet cleaning block, which contains a fragrance, a chlorine-containing disinfectant, at least one alkylbenzene sulfonate, at least one olefin sulfonate, at least one other anionic surfactant, and a nonionic surfactant. The alkylbenzene sulfonate accounts for 10 wt % to 70 wt % of the cleaning block. The olefin sulfonate accounts for 10 wt % to 30 wt % of the cleaning block. There is no more than 2.5 wt % of the nonionic surfactant. The cleaning block includes up to 20 wt % of the other anionic surfactant. The other anionic surfactant is, for example, an aliphatic sulfate or an aliphatic sulfonate.

U.S. Pat. No. 6,635,610 discloses a detergent granule which comprises a first particulate component, a second particulate component, and a binding agent. The first particulate component includes an anionic sulphate surfactant, but does not include an anionic sulphonate surfactant. The second particulate component includes an anionic sulphonate surfactant and an inorganic carbonate salt, but does not include an anionic sulphate surfactant or an aluminosilicate. The ingredients of the first particulate component are not mixed with the ingredients of the second particulate component. Accordingly, the anionic sulphate surfactant of the first component is not intimately mixed with the anionic sulphonate surfactant of the second component.

However, the above-mentioned patent references, as well as other prior art granular cleaning products, still suffer from the problem of granules agglomerating to each other into clumps. Thus, there exists a need for an improved solid granule used for cleaning agents that prevents or at least minimizes the occurrence of agglomeration.

SUMMARY

The needs set forth herein as well as further and other needs and advantages are addressed by the present embodiments, which illustrate solutions and advantages described below.

It is an object of the present teachings to provide a cleaning granule which has good fluidity (flow properties), is not sticky (e.g., little to no adhesive force such that one granule does not stick to other granules and agglomerate), and has the characteristic of low dosage and high cleaning power during use.

It is another object of the present teachings to provide cleaning granules which are uniform or substantially uniform in shape and/or size. As one example, the cleaning granules have a spherical or substantially spherical shape. The term "substantially" used herein with respect to the shape of the cleaning granules means that the sphericity (measure of how closely the shape of an object resembles that of a perfect sphere) of the cleaning granules is at least 0.85, and preferably at least 0.90, and more preferably at least 0.95.

It is a further object of the present teachings to provide a tablet or pod containing one or more granules which are non-sticky, have good fluidity (flow properties), do not stick to other granules and agglomerate, and have the characteristic of low dosage and high cleaning power during use.

It is also an object of the present teachings to provide a laundry detergent, dishwasher cleaner, dishwasher detergent, dish cleaner, kitchen cleaner, bathroom cleaner, toilet cleaner, sink cleaner, tub cleaner, tile cleaner, carpet/rug cleaner, all-purpose cleaner, floor cleaner, multi-surface cleaner, hand wash, and body wash each comprising one or more granules according to the present teachings.

These and other objects of the present teachings are achieved by providing a solid cleaning granule comprising an anionic surfactant component and a granule-forming (binding and/or molding) agent which are mixed with one another in a uniform mixture. In other words, the constituents forming the anionic surfactant component and the granule-forming agent are intimately mixed, thereby providing a homogenous mixture. The anionic surfactant component may include an anionic sulfonate surfactant and an anionic fatty alcohol-based sulfate surfactant. In some embodiments, the sulfonate surfactant may be an alkyl ester sulfonate surfactant, while the fatty alcohol-based sulfate surfactant may be an alkyl sulphate surfactant and/or alkoxylated alkyl sulphate surfactant. The molding agent may comprise a polyhydric alcohol.

Based on the total amount of the cleaning granule being 100 wt %, the total amount of sulfonate surfactant and fatty alcohol-based sulfate surfactant combined may be greater than 15.0 wt % and less than 100 wt %, preferably between 15.0 wt % and 60.0 wt %, and more preferably between 18.0 wt % and 60.0 wt %, inclusive. The amount of sulfonate surfactant may be between 3.0 wt % and 25.0 wt %, while the amount of the sulfate surfactant may be between 10.0 wt % and 50.0 wt %. The amount of the granule-forming agent contained in the solid granule may be between 1.0 wt % and 5.0 wt %. The ratio of the sulfonate surfactant to the sulfate surfactant may be between 0.20 and 0.75, inclusive. As a result of the granule formulation and ratios of components, sufficient cohesiveness is produced in the solid granule such that it can be extruded and molded easily. Additionally, the composition formula and ratios of components result in the granule having little to no adhesive force (i.e., minimal stickiness). The granule accordingly does not require the inclusion of an anti-sticking agent in its formulation. That is, there is no anti-sticking agent in the cleaning granule. By controlling the cohesiveness through the composition formula, the solid granule has a solubility reaching at least 20 g (grams of solute per 1000 grams of solvent) and is adapted to dissolve in approximately 6 minutes or less. In this context, the term "approximately" means plus or minus 30 seconds. The cleaning granule has good elasticity and good fluidity and exhibits low stickiness/adhesive properties. The individual components of the cleaning granule agglomerate well with each other, but the cleaning granule once formed does not stick to or agglomerate with other like granules during storage or transport.

The cleaning granule may have a spherical or substantially round shape and a diameter within a range of approximately 3.0 mm and approximately 20.0 mm. In one embodiment, the diameter may be within a range of approximately 5.0 mm and approximately 20.0 mm. In a preferred embodiment, the diameter may be greater than 6.0 mm and less than 20.0 mm, approximately. Still yet, the diameter may be greater than 10.0 mm and less than 20.0 mm, approximately. The term "approximately" in the context of granule size means within 0.5 mm of the lower limit and 0.5 mm of the upper limit.

The present teachings also provide a cleaning granule comprising an anionic surfactant component, a granule-forming (binding and/or molding) agent, and an anti-sticking agent. All three main components of the granule may be mixed with one another into a uniform mixture. In other words, the constituents forming the anionic surfactant component, the granule-forming agent, and the anti-sticking agent are intimately mixed, thereby providing a homogenous mixture. The anionic surfactant component may include an anionic sulfonate surfactant and an anionic fatty alcohol-based sulfate surfactant. Based on the total amount of the cleaning granule being 100 wt %, the total amount of the anionic sulfonate surfactant and the anionic fatty alcohol-based sulfate surfactant combined may be greater than 15.0 wt % and less than 100 wt %. The ratio of the anionic sulfonate surfactant to the anionic sulfate surfactant may be between 0.20 and 0.75, inclusive. In some embodiments, the ratio of the anionic sulfonate surfactant to the anionic sulfate surfactant may be between 0.20 and 0.40, inclusive. As a result of uniform mixing, the anionic sulfonate surfactant and the anionic fatty alcohol-based sulfate surfactant are intimately mixed.

The technical effect of a cleaning granule according to the present teachings, especially with respect to its composition and the amounts of sulfonate surfactant, sulfate surfactant, and granule-forming agent (in some embodiments, also the anti-sticking agent), is that the cleaning granule has good elasticity and good fluidity and exhibits low stickiness/adhesive properties. The individual components of the cleaning granule agglomerate well with each other, but the cleaning granule once formed does not stick to or agglomerate with other like granules during storage or transport. Further, the cleaning granule provides high cleaning power at low dosage when used.

The present teachings also provide a cleaning granule comprising an anionic surfactant component, a granule-forming (binding and/or molding) agent, and an anti-sticking agent, wherein the three components are intimately mixed into a homogenous mixture. The cleaning granule may have a spherical or substantially round shape and a diameter within a range of approximately 3.0 mm and approximately 20.0 mm. In one embodiment, the diameter may be within a range of approximately 5.0 mm and approximately 20.0 mm. In a preferred embodiment, the diameter may be greater than 6.0 mm and less than 20.0 mm, approximately. Still yet, the diameter may be greater than 10.0 mm and less than 20.0 mm, approximately. The anionic surfactant component may include an anionic sulfonate surfactant and an anionic fatty alcohol-based sulfate surfactant. Based on the total amount of the cleaning granule being 100 wt %, the total amount of the anionic sulfonate surfactant and the anionic fatty alcohol-based sulfate surfactant combined may be greater than 15.0 wt % and less than 100 wt %. The ratio of the anionic sulfonate surfactant to the anionic sulfate surfactant may be between 0.20 and 0.75, inclusive. In some embodiments, the ratio of the anionic sulfonate surfactant to the anionic sulfate surfactant may be between 0.20 and 0.40, inclusive. In some embodiments, the total amount of the anionic sulfonate surfactant and the anionic fatty alcohol-based sulfate surfactant combined may be greater than 15.0 wt % and less than 100 wt %. In other embodiments, the total amount may be greater than 18.0 wt % and less than 80.0 wt %. In yet other embodiments, the total amount of the anionic sulfonate surfactant and the anionic fatty alcohol-based sulfate surfactant combined may be greater than 20.0 wt % and less than 75.0 wt %.

In some embodiments, the cleaning granule may comprise additional ingredients which are uniformly mixed with the anionic surfactant component, anti-sticking agent, and granule-forming (binding and/or molding) agent to form the granule. These additional ingredients may be, for example, an enzyme component, fragrance component, disintegrate, alkali agent, chelating agent, etc. In addition to or alternatively, the extra ingredients may be encapsulated by the mixture of the anionic surfactant component and the granule-forming agent (and the anti-sticking agent in some embodiments). Still, in addition to or alternatively, the extra ingredients may be added as a coating around the mixture of the anionic surfactant component and the granule-forming agent (and the anti-sticking agent in some embodiments). The spherical configuration of the cleaning granule and the granule diameter greater than 3.0 mm and preferably greater than 6.0 mm impart several benefits. First, compared to irregular shapes, the round shape (i.e., spherical or substantially spherical shape) is less likely to break during transportation and storage. Second, these features of the granule are more aesthetically pleasing to consumers and provide for specificity and recognition. Third, the round shape (i.e., spherical or substantially spherical shape) provides an optimal surface(s) for coating additional ingredients, such as enzymes, fragrance components, disintegrates, bittering agents, chelating agents, alkali agents, etc., around the granule.

It is noted that all ranges disclosed herein with respect to wt % and ratios may be inclusive of the upper and/or lower limits, unless otherwise indicated. As used herein, "about" or "approximately" means reasonably close to, or a little more or less than, the given number or range.

Other features and aspects of the present teachings will become apparent from the following detailed description, taken in conjunction with the accompanying drawings, which illustrate by way of example the features in accordance with embodiments of the present teachings. The summary is not intended to limit the scope of the present teachings, which is defined by the claims included herein.

BRIEF DESCRIPTION OF THE DRAWINGS

FIGS. 6A-6C is table depicting various examples of the cleaning granule according to the present teachings, in comparison with other granules.

It should be understood that through the drawings corresponding reference numerals indicate like or corresponding parts and features.

DETAILED DESCRIPTION

The present teachings are described more fully hereinafter with reference to the accompanying drawings, in which the present embodiments are shown. The following description illustrates the present teachings by way of example, not by way of limitation of the principles of the present teachings.

The present teachings have been described in language more or less specific as to structural features. It is to be understood, however, that the present teachings are not limited to the specific features shown and described, since the product herein disclosed comprises preferred forms of putting the present teachings into effect.

Other than in the operating examples, or where otherwise indicated, all numbers expressing quantities of ingredients or reaction conditions used herein are to be understood as modified in all instances by the term "about".

Figure 1:
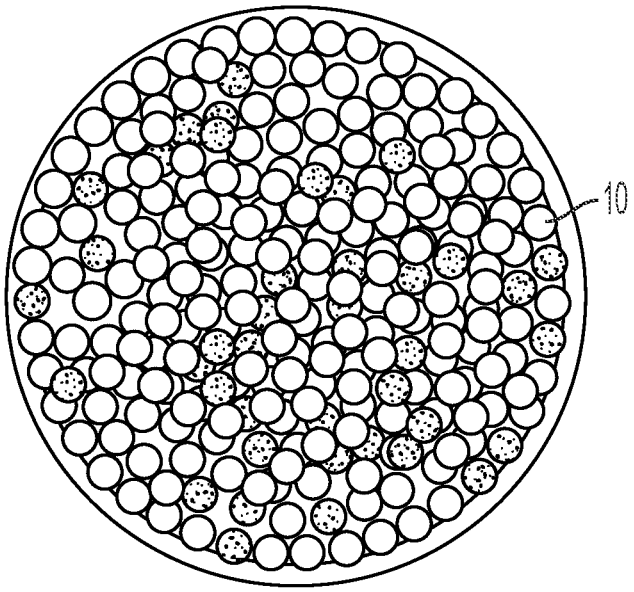
FIG. 1 is an exemplary view of multiple cleaning granules according to the present teachings.
Figure 2:
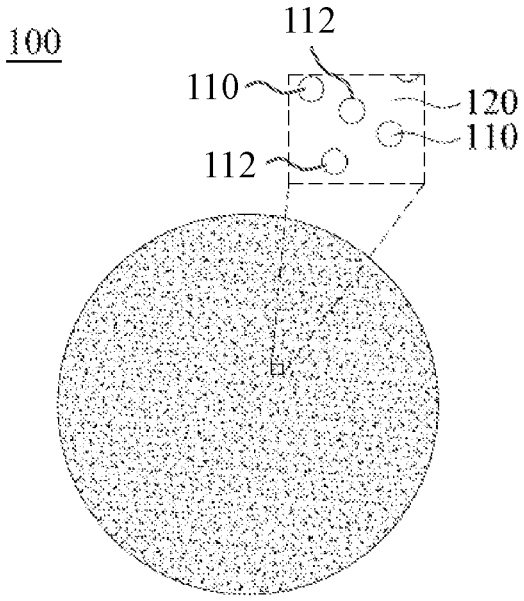
FIG. 2 is a cross-sectional diagram of a cleaning granule according to the present teachings.

FIG. 1 shows a top view of a plurality of cleaning granules 10. Each cleaning granule has a uniform (e.g., same or substantially same) shape and size. That is, each granule according to the present teachings is manufactured to have a uniform size and/or shape. As shown in FIG. 2, the cleaning granule 10/100 comprises an anionic surfactant component 110, 112 and a granule-forming (binding and/or molding) agent 120, wherein the anionic surfactant component includes an anionic sulfonate surfactant 110 and an anionic fatty alcohol-based sulfate surfactant 112. The anionic sulfonate surfactant 110, anionic fatty alcohol-based sulfate surfactant 112, and granule-forming agent 120 are mixed into a homogenous mixture, preferably uniformly mixed. In some embodiments, the sulfonate surfactant 110 may be an alkyl ester sulfonate surfactant. In some embodiments, the fatty alcohol-based sulfate surfactant 112 may be an alkyl sulphate surfactant and/or alkoxylated alkyl sulphate surfactant. The molding agent may comprise a polyhydric alcohol.

The amount of sulfonate surfactant 110 may be between 3.0 wt % and 25.0 wt %, while the amount of the sulfate surfactant may be between 10.0 wt % and 50.0 wt %. Narrower ranges of the sulfonate surfactant and the sulfate surfactant may be preferred in some embodiments. For example, the amount of sulfonate surfactant 110 may be between 5.0 wt % and 25.0 wt %, or between 3.0 wt % and 21.0 wt %, or more so between 9.0 wt % and 21.0 wt %. In some cases, the sulfate surfactant 112 may be between 15.0 wt % and 50.0 wt %, and more so between 15.0 wt % and 40.0 wt %. The binding and/or molding agent provided in the cleaning granule may vary between 1.0 wt % and 5.0 wt %. In some embodiments, the amount of binding and/or molding agent may be between 1.0 wt % and 3.0 wt %.

The total amount of the anionic sulfonate surfactant and the anionic fatty alcohol-based sulfate surfactant may be greater than 15.0 wt % and less than 100 wt % of the cleaning granule. In some embodiments, the total amount of the anionic surfactant component in the cleaning granule may range from 18.0 wt % to 75.0 wt %. In other embodiments, the total amount of the anionic surfactant component in the cleaning granule may range from 20.0 wt % to 75.0 wt %. The ratio of the anionic sulfonate surfactant to the anionic sulfate surfactant may be between 0.20 to 0.75. In some embodiments, the ratio of the anionic sulfonate surfactant to the anionic sulfate surfactant may be between 0.20 to 0.50.

It has been found that if the total amount of sulfonate surfactant and sulfate surfactant is less than or equal to 20.0 wt %, the granule-forming agent should preferably be in the range between 4.0 wt % and 5.0 wt %. If the total amount of sulfonate surfactant and sulfate surfactant is between 20.0 wt % and 30.0 wt %, then the amount of granule-forming agent is preferably between 3.0 wt % and 4.0 wt %. If the total amount of sulfonate surfactant and sulfate surfactant is between 30.0 wt % and 40.0 wt %, then the granule-forming agent is preferably between 2.0 wt % and 3.0 wt %. Finally, it has been found that if the total amount of sulfonate surfactant and sulfate surfactant is greater than or equal to 40.0 wt %, then the granule-forming agent is preferably less than or equal to 2.0 wt %.

With the above composition/formulation, wt % range, and ratios, the solid granule possesses satisfactory cohesiveness, and for example cohesiveness in the range of 1000-4000 g/mm. By controlling the cohesiveness of the cleaning granule, the solubility of the granule is configured to reach 20 g (grams of solute per 100 grams of solvent or grams of solute per liter of solvent) and dissolve in approximately 6 minutes or less. The formulation and the amount of each component, as described above, allows for efficient production of the cleaning granule. For example, a cleaning granule based on the present teachings can be extruded and molded in a manufacturing process involving a curved knife die. When the amount of granule-forming agent does not adhere to the above threshold ranges, too little will produce insufficient moisture in the granular composition. As a result, during the manufacturing process, extruded strips of the granular composition (i.e., before being formed into solid spheres) will be very dry and hard. This negative effect increases the potential for the composition to become stuck in production devices (e.g., molding machine). Conversely, if there is too much of the granule-forming agent, the granular composition will be too wet and cause the final granules to stick to each other, and at the same time, the dissolution rate will reduce (i.e., increasing time to completely dissolve).

The granule in general has a round shape with curved surfaces and contouring. More specifically, the granule has an oval or substantially oval shape, or a spherical or substantially spherical shape. The term "substantially" used herein with respect to the shape of the cleaning granules means that the sphericity (measure of how closely the shape of an object resembles that of a perfect sphere) of the cleaning granules is at least 0.90, and preferably at least 0.95. The round shape minimizes the likelihood that the cleaning granule breaks during transportation and storage. The size of the granule may be approximately between 3.0 mm and 20.0 mm. In some embodiments, the granule size may be approximately between 5.0 mm and 20.0 mm, or preferably between 6.0 mm and 20.0 mm, or preferably between 10.0 mm and 20.0 mm.

Figure 3:
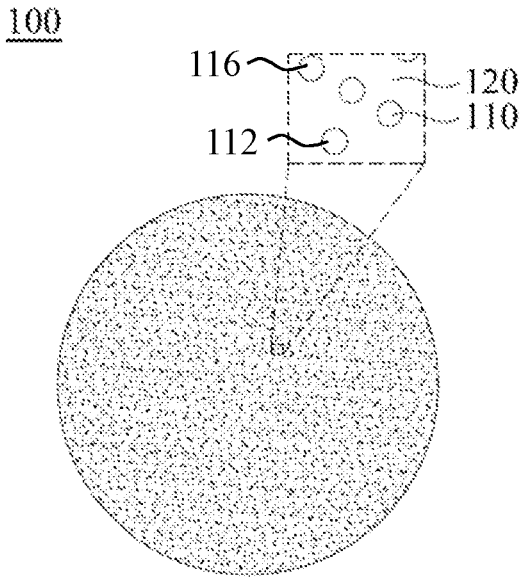
FIG. 3 is a cross-sectional diagram of a cleaning granule according to the present teachings.

As shown in FIG. 3, the cleaning granule 10/100 may comprise an anionic surfactant component 110, 112, a viscosity-reducing (anti-sticking) agent 116, and a granule-forming (binding and/or molding) agent 120, wherein the anionic surfactant component includes an anionic sulfonate surfactant 110 and an anionic fatty alcohol-based sulfate surfactant 112. The total amount of the anionic sulfonate surfactant and the anionic fatty alcohol-based sulfate surfactant may be greater than 15.0 wt % and less than 100 wt % of the cleaning granule. The ratio of the anionic sulfonate surfactant to the anionic sulfate surfactant may be between 0.20 to 0.75, inclusive. In some embodiments, the total amount of the anionic surfactant component in the cleaning granule may range from 20.0 wt % to 75.0 wt %. In some embodiments, the ratio of the anionic sulfonate surfactant to the anionic sulfate surfactant may be between 0.20 to 0.50 or between 0.20 to 0.40, inclusive.

FIG. 3 further illustrates that the anionic sulfonate surfactant 110, anionic fatty alcohol-based sulfate surfactant 112, viscosity-reducing agent 116, and granule-forming agent 120 are uniformly mixed into a homogenous mixture. The granule in general has a round shape with curved surfaces and contouring. For example, the granule has an oval shape or preferably a spherical shape. The round or spherical shape minimizes the likelihood that the cleaning granule breaks during transportation and storage. As will be described further below, additional ingredients may be added to the granule shown in FIG. 2 or 3. For example, additional ingredients may be uniformly mixed with the anionic sulfonate surfactant 110, anionic fatty alcohol-based sulfate surfactant 112, and granule-forming agent 120 (and anti-sticking agent 116 if present) to form the granule 10/100. The additional ingredients include for example, but are not limited to, enzymes, fragrances, disintegrates, bittering agents, chelating agents, and alkali agents. In some embodiments, additional ingredients may be encapsulated by the mixture of the surfactants 110, 112, viscosity-reducing agent 116, and granule-forming agent 120. Encapsulation helps with certain active ingredients (e.g., enzymes, fragrances), which may be sensitive to air and humidity and thus lose their effectiveness if exposed to an open ambient environment for an extended period of time. In some embodiments, additional ingredients may be added as layers of coating around the mixture of the surfactants 110, 112, viscosity-reducing agent 116, and granule-forming agent 120. Irrespective of how the additional ingredients are incorporated with the base components, the cleaning granule has a round or spherical structural shape.

Anionic Surfactant Component

The anionic surfactant component includes at least one anionic sulfonate surfactant and at least one anionic fatty alcohol-based sulfate surfactant. In some embodiments, two or more different types of sulfonate surfactants may be used in the anionic surfactant component. In other embodiments, two or more different types of sulphate surfactants may be used in the anionic surfactant component. It is understood to a person of ordinary skill in the art that any number of sulfonate surfactants may be combined with any number of sulfate surfactants to form the anionic surfactant component.

Anionic Sulfonate Surfactant

The anionic sulfonate surfactant may comprise, but is not limited to, a fatty acid ester sulfonate, an aliphatic sulfonate, fluorenyl taurate, etc. The fatty acid ester sulfonate can be used alone or in combination with other types of sulfonate surfactants. The fatty acid ester sulfonate may be, for example, but is not limited to, sodium fatty acid methyl ester sulfonate, sodium fatty acid ethyl sulfonate (sodium fatty acid ethyl ester sulfonate), sodium dioctyl sulfosuccinate, or any combination thereof. The fatty acid ester sulfonate is selected from $C_8$-$C_{20}$ fatty acid ester sulfonate, and may preferably be selected from $C_{10}$-$C_{18}$ fatty acid ester sulfonate. The aliphatic sulfonate can be used alone or in combination with other types of sulfonate surfactants. The aliphatic sulfonate may be, for example, but is not limited to, a secondary alkyl sulfonate or a combination of secondary alkyl sulfonates. The secondary alkyl sulfonate is selected from $C_8$-$C_{18}$ secondary alkyl sulfonate, and may preferably be selected from $C_{14}$-$C_{17}$ secondary alkyl sulfonate. The secondary alkyl sulfonate may be, for example, but is not limited to, sodium secondary alkyl sulfonate. The fluorenyl taurate may be, for example, but is not limited to, sodium methyl stearoyl taurate, sodium methyl myristoyl taurate, sodium methyl cocoyl taurate, or any combination thereof. The content of the anionic sulfonate surfactant may range from 3.0 wt % to 25.0 wt % based on the total amount of the cleaning granule being 100 wt %. In some embodiments, the anionic sulfonate surfactant may be between 5.0 wt % and 25.0 wt %, or between 3.0 wt % and 21.0 wt %, or more so between 9.0 wt % and 21.0 wt %.

Referring to the cleaning granule shown in FIG. 2 for example, the anionic sulfonate surfactant may comprise at least one alkoxylated sulfonate and/or at least one alkyl ester sulfonate. The alkoxylated sulfonate may be selected from sodium $C_{14}$-$C_{15}$ olefin sulfonate, sodium $C_{12}$-$C_{15}$ alkanol polyether-15 sulfonate, sodium $C_{14}$-$C_{17}$ secondary alkyl sulfonate, sodium $C_{14}$ olefin sulfonate, ammonium cumene sulfonate, ammonium dodecylbenzene sulfonate, calcium dodecylbenzene sulfonate, DEA myristate, disodium decylphenyl ether disulfonate, disodium lauriminodipropyl sulfonate, disodium laurylphenyl ether disulfonate, isopropylamine dodecylbenzene sulfonate, magnesium isododecylbenzene sulfonate, magnesium dodecylhydroxypropyl sulfonate, MEA salt of $C_{10}$-$C_{13}$ alkylbenzene sulfonic acid, MIPA dodecylbenzene sulfonate, potassium dodecylhydroxypropyl sulfonate, sodium $C_{13}$-$C_{17}$ alkane sulfonate, sodium $C_{14}$-$C_{18}$ alkane sulfonate, sodium $C_{10}$-$C_{13}$ alkylbenzene sulfonate, sodium $C_9$-$C_{22}$ secondary alkyl sulfonate, sodium $C_{14}$-$C_{17}$ secondary alkyl sulfonate, Sodium hexanoyl ethylformylbenzene Sulfonate, Sodium octanoyl PG-Sulfonate, Sodium octanoyl Sulfonate, Sodium cocoyl glucoside hydroxypropyl Sulfonate, Sodium cocoyl glyceryl ether Sulfonate, Sodium cocoyl monoglyceride Sulfonate, Sodium $C_{12}$-$C_{14}$ olefin Sulfonate, Sodium $C_{14}$-$C_{16}$ olefin Sulfonate, Sodium $C_{14}$-$C_{18}$ olefin Sulfonate, Sodium $C_{16}$-$C_{18}$ olefin Sulfonate, Sodium $C_{14}$-$C_{18}$ alkanol polyether-PG Sulfonate, Sodium $C_{12}$-$C_{15}$ alkanol polyether-3 Sulfonate, Sodium $C_{12}$-$C_{15}$ alkanol polyether-7 Sulfonate, Sodium $C_{12}$-$C_{15}$ alkanol polyether-15 Sulfonate, Sodium decyl benzene Sulfonate, Sodium decyl glucoside hydroxypropyl Sulfonate, Sodium dodecyl benzene Sulfonate, Sodium hydroxypropyl palmitate Sulfonate, Sodium lauroyl hydroxypropyl Sulfonate, Sodium lauroyl glucoside hydroxypropyl Sulfonate, Sodium methyl laurate Sulfonate (Sodium lauryl sulfate).

If the anionic sulfonate surfactant is an alkyl ester sulfonate, it has the following structural formula:

$R^1$—CH($SO_3$M)-C(O)—$OR^2$ where $R^1$ is a $C_6$-$C_{22}$ hydrocarbyl, $R^2$ is a $C_1$-$C_8$ hydrocarbyl, and M is a soluble salt-forming cation (such as sodium, potassium, and/or lithium) or a substituted or unsubstituted ammonium cation (such as monoethanolamine, diethanolamine, and/or triethanolamine). Preferably, $R^1$ is $C_8$-$C_{18}$ alkyl, and $R^2$ is methyl, ethyl or isopropyl. The alkyl group $R^1$ may have a mixture of chain lengths.

Anionic Sulfate Surfactant

The anionic fatty alcohol-based sulfate surfactant can be used alone or in combination with other types of sulfate surfactants. The anionic fatty alcohol-based sulfate surfactant may be, for example, but is not limited to, fatty alcohol sulfate, fatty alcohol ether sulfate, or a combination thereof. The fatty alcohol sulfate may be, but is not limited to, sodium lauryl sulfate, sodium coco-sulfate, a like ingredient, or any combination thereof. The fatty alcohol ether sulfate may be, but is not limited to, sodium laureth sulfate. The content of the anionic fatty alcohol-based sulfate surfactant may range from 15.0 wt % to 60.0 wt % based on the total amount of the cleaning granules being 100 wt %. In some embodiments, the sulfate surfactant may be between 15.0 wt % and 50.0 wt %, and preferably between 15.0 wt % and 40.0 wt %.

Referring to the cleaning granule shown in FIG. 2 for example, the anionic sulfate surfactant may comprise at least one water-soluble alkyl sulfate and/or at least one water-soluble alkyl ester sulfate. The water-soluble alkyl sulfate has the general formula:

$ROSO_3M$ where R is an alkyl (including unsaturated alkene) substituent containing from about 8 to 18 carbon atoms, and where M is a cation selected to provide water-solubility of the alkyl sulfate, e.g., alkali metals, ammonium, alkanolammonium, and the like. Substituent R can be branched or straight chain, but is preferably straight chain, since such materials are biodegradable. One example of the alkyl sulfate is:

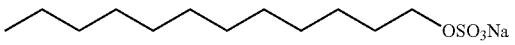

sodium lauryl sulfate

The water-soluble alkyl ester sulfate surfactant may preferably be an alkoxylated alkyl sulfate detersive surfactant. Such detersive surfactant may be a linear or branched, substituted or unsubstituted $C_{8-18}$ alkyl alkoxylated sulphate detersive surfactant having an average degree of alkoxylation of from 1 to 30, preferably from 1 to 10. The alkoxylated alkyl sulfate detersive surfactant may be a linear or branched, substituted or unsubstituted $C_{8-18}$ alkyl ethoxylated sulfate having an average degree of ethoxylation of from 1 to 10. More preferably, the alkoxylated alkyl sulfate detersive surfactant is a linear unsubstituted $C_{8-18}$ alkyl ethoxylated sulphate having an average degree of ethoxylation of from 3 to 7.

Granule-Forming (Binding and/or Molding) Agent

The granule-forming agent (binding and/or molding agent) is, for example, a polyol molding agent. The forming agent may be used alone or in combination with other molding agents. The forming agent may be, for example, but is not limited to, glycerin, propylene glycol, butylene glycol (butanediol), caprylyl glycol, ethylhexyl glycerin, sucrose, trehalose, sorbose, melezitose, sorbitol, stathiose, raffinose, fructose, mannose, maltose, lactose, arabinose, xylose, ribose, rhamnose, galactose, glucose, mannitol, xylitol, erythritol, threitol, polyethylene glycol, a similar polyhydric alcohol, or any combination thereof. The forming agent is configured to help the components of the cleaning granule agglomerate with one another, and make the cleaning granule have sufficient plasticity, elasticity, and lubricity. The granule will have a softness similar to dough. Therefore, in manufacturing the cleaning granule, during a molding process, the cleaning granule is able to smoothly pass through the output port of the molding machine without accumulating at the output port, thereby preventing or at least minimizing the chance of a blockage or clogging. In addition, the forming agent may be configured to make an object being cleaned (e.g., clothes) soft.

Based on the total amount of the cleaning granule being 100 wt %, the amount of granule-forming agent provided in the granule may be between 0.5 wt % and 15.0 wt %. If the weight percentage of the granule-forming agent is below this range, then the granule may become very hard and fragile after pressure and extrusion during manufacturing. If the weight percentage of the granule-forming agent is above this range, then the granule may stick to the equipment during manufacturing, thereby causing clogs and other production problems. In some embodiments, the amount of granule-forming agent may be between 1.0 wt % and 5.0 wt %.

Viscosity-Reducing (Anti-Sticking) Agent

One purpose of the anti-sticking agent is to help prevent the cleaning granule from sticking to other like granules and agglomerating during storage. The anti-sticking agent can be used alone or in combination. The anti-sticking agent can be, for example, but is not limited to, layered sodium disilicate, zeolite (aluminosilicate), or any combination thereof. The zeolite in the cleaning granule can be a natural zeolite or alternatively a synthetic zeolite, which is purer than natural zeolites.

Based on the total amount of the cleaning granule being 100 wt %, the amount of anti-sticking agent provided in the granule may be between 0 wt % (i.e., where no anti-sticking agent is included, as shown in FIG. 2) and 3.0 wt %. In some embodiments, the amount of anti-sticking agent may be between 0.3 wt % to 3.0 wt %. Still, in other embodiments, the amount of anti-sticking agent may be between 0.5 wt % and 3.0 wt %. If the weight percentage of the anti-sticking agent is below this range, then it may fail to provide sufficient viscosity reduction to prevent granules from clumping to each other. If the weight percentage of the anti-sticking agent is above this range, then the base components (anionic surfactant component and granule-forming agent) may become loose and fail to agglomerate to create the spherical structure of the granule.

Figure 4:
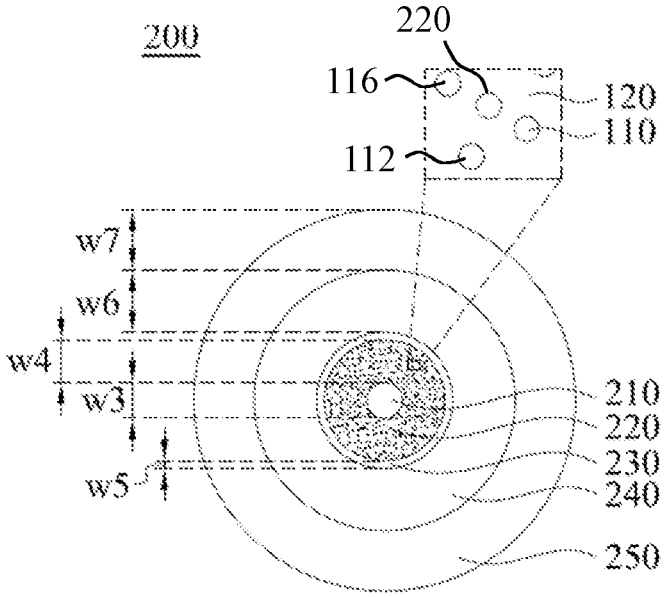
FIG. 4 is a cross-sectional diagram of a cleaning granule according to the present teachings, encapsulated with additional layers of ingredients.

Referring to FIG. 4, the cleaning granule 200 may comprise one or more further ingredients to provide additional characteristics and functions to the cleaning granule. The further ingredients 230-250 may be applied as a coating around the main components of the cleaning granule (anionic surfactant component, viscosity-reducing agent, granule-forming agent). The addition of further ingredients to the granule layer by layer eventually forms multiple concentric coatings around the base granule. The order in which each further ingredient is added to the granule may depend on the type and functionality of the further ingredients. In addition to or alternatively, the further ingredient(s) 210 may be encapsulated by the main components of the cleaning granule. Further, in addition to or alternatively, the further ingredient(s) 220 may be mixed uniformly with the main components of the granule.

One example of a further ingredient includes a disintegrant. The disintegrant is an agent that causes the cleaning granule to dissolve rapidly on contact with moisture. The disintegrant may be used alone or in combination with other disintegrants. The disintegrant may be, for example, but is not limited to, cellulose-based materials, starch-based materials, acrylic materials, polyvinylpyrrolidone (polyvidone), tartaric acid, citric acid, sodium bicarbonate, or any combination thereof. The cellulose-based material may be, for example, but is not limited to, carboxymethyl cellulose, hydroxypropyl methylcellulose, a like ingredient, or any combination thereof. The starch-based material may be, for example, but is not limited to, corn starch, potato starch, a like ingredient, or any combination thereof. The content of the disintegrant may range from 0 wt % to 40.0 wt % based on the total amount of the cleaning granules being 100 wt %. In some embodiments, the content of the disintegrant may range from 0 wt % to 3.0 wt %. In other embodiments, the distintegrant content may be between 1.0 wt % and 3.0 wt %.

In order to give the cleaning granule a scent, the cleaning granules may include a fragrance component. The fragrance component includes at least one perfume. The at least one perfume may be, for example, but is not limited to, an essential oil. The essential oil can comprise orange oil, lavender oil, peppermint oil, lemon oil, eucalyptus oil, tea tree oil, lemon grass oil, chamomile oil, etc., or any combination thereof.

In order to improve or increase the cleaning power of the cleaning granule, an enzyme component may be included in the granule. The enzyme component also provides fabric care benefits. The enzyme component comprises at least one enzyme. The at least one enzyme may be, for example, but is not limited to, hemicellulase, peroxidase, protease, cellulase, xylanase, lipase, phospholipase, esterase, cutinase, pectinase, mannanase, pectate lyase, keratinase, reductase, oxidase, phenol oxidase, lipoxygenase, ligninase, pullulanase, tannases, pentosanases, malanases, β-glucanases, arabinosidases, hyaluronidases, chondroitinases, laccases and amylases, or any combination thereof.

In order to make the cleaning granules more effective in removing greasy soils and neutralizing acidic soils to avoid the odor caused by acidic soils, the cleaning granule may also include an alkali agent. The alkali agent can be used alone or in combination with other like agents having similar effects. The alkali agent may be, for example, but is not limited to, sodium sulfate, sodium carbonate, sodium bicarbonate, sodium silicate, tetrasodium orthosilicate, or any combination thereof.

The cleaning granule may also include a further ingredient that makes it have increased or enhanced cleaning power in hard water or water with high hardness (for example, 150 or more (ppm or mg/L)). Specifically, the cleaning granule includes a chelating agent. The chelating agent helps to remove scale, soften the water and boost the hygienic cleaning action. The chelating agent may be used alone or in combination. The chelating agent may be, for example, but is not limited to, sodium gluconate, sodium citrate, potassium citrate, glutamic acid diacetate, tetrasodium glutamate diacetate, etc., or any combination thereof. Other suitable chelants include diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid). In some embodiments, the chelant is ethylene diamine-N'N'-disuccinic acid (EDDS) and/or hydroxyethane diphosphonic acid (HEDP). The solid granule composition may preferably comprise ethylene diamine-N'N'-disuccinic acid or salt thereof. The ethylene diamine-N'N'-disuccinic acid may for example be in S'S' enantiomeric form. In some embodiments, the solid granule comprises 4,5-dihydroxy-m-benzenedisultonic acid disodium salt.

One concern with conventional powder cleaning products is the accidental poisoning of a person, child, or pet when the product is ingested. In order to reduce the likelihood of ingestion, the cleaning granule of the present teachings may include an irritating-flavor agent. The irritating-flavor agent imparts an offensive taste to the cleaning granule for the purpose of inducing the person or pet to spit out the cleaning granule prior to being ingested. The irritating-flavor agent can be used alone or in combination, and can be, for example, but is not limited to, a bittering agent. The bittering agent may comprise denatonium benzoate, naringin, sucrose octaacetate, caffeine, quinine, theobromine, etc., or any combination thereof. Preferably, the irritating-flavor agent is applied to the granule as the outermost layer if other further ingredients are added to the granule in order to ensure immediate effect. This means that other further ingredients, such as the disintegrant, fragrance component, enzyme component, alkali agent, and/or chelating agent are disposed within the interior of the layer of irritating-flavor agent.

Referring back to the cleaning granule shown in FIG. 1, in order to reduce the dust particles of the cleaning granule and/or to reduce the ingress of moisture or air into the cleaning granule which could cause the enzyme component or the fragrance component to lose its effect, the cleaning granule may have an outer protective coating so that these active ingredients (e.g., fragrance, enzyme) remain stable and stably exist in the cleaning granule under long-term storage. In some embodiments, the active ingredients may be encapsulated by the mixture of the surfactants, the viscosity-reducing agent, and the granule-forming agent. When the fragrance component is in the form of microcapsules, the fragrance component can be effectively coated. As a result, the cleaning granule can maintain a persistent scent throughout its storage life. In some embodiments, the particle size of the cleaning granule (surfactant component 110, 112, viscosity-reducing (anti-sticking) agent 116, and granule-forming (binding and/or molding) agent 120) may be between 6.0 mm and 20.0 mm. In other embodiments, the particle size of the cleaning granule may range from 3.0 mm to 20.0 mm. In yet other embodiments, the particle size of the cleaning granule may range from 6.0 mm to 10.0 mm. By making the size of the granule greater than 3.0 mm and preferably greater than 6.0 mm, this reduces the likelihood that the granule will break during transportation and storage. To effectively reduce the entry of moisture or air into the cleaning granule and to help reduce packaging and transportation costs, the density of the cleaning granule is more than 1000 g/L. To minimize the adverse loss in effectiveness of the enzyme component due to the influence of water, the water content of the cleaning granule is less than 1 wt %.

Figure 5:
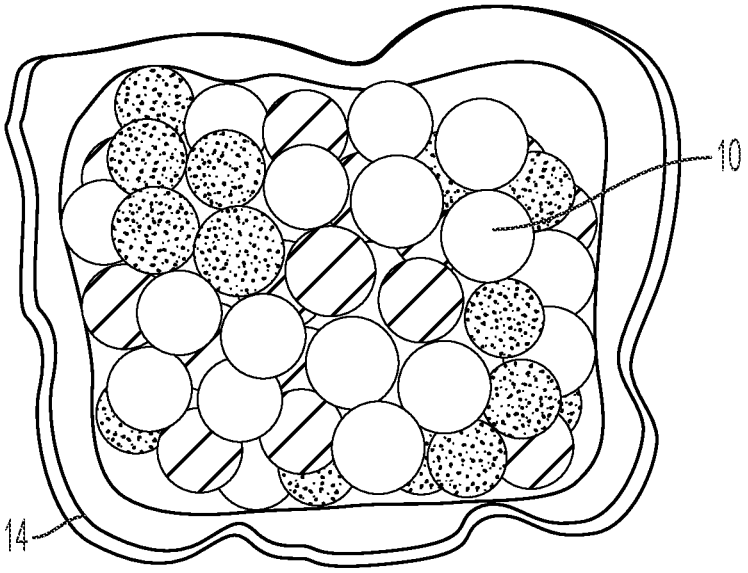
FIG. 5 is an exemplary view of a pod containing a plurality of cleaning granules according to the present teachings.

The cleaning granule according to the present teachings may be incorporated into or used to form various cleaning products, such as laundry detergents, detergents for kitchen utensils and dishware, bathroom cleaners, body soap or cleaners (for human or pet), bathing agents, or the like. Specifically, the present teachings provide for a laundry detergent, dishwasher cleaner, dishwasher detergent, dish cleaner, kitchen cleaner, bathroom cleaner, toilet cleaner, sink cleaner, tub cleaner, tile cleaner, carpet/rug cleaner, all-purpose cleaner, floor cleaner, multi-surface cleaner, hand wash, or body wash containing one or more cleaning granules as described above. As shown in FIG. 5, a plurality of the cleaning granules 10 may be enclosed within a pod, tablet, or other water-soluble pouch 14. Various examples of the cleaning granule 10 with their respective composition/formulation are shown in FIGS. 6A-6C. This figure also demonstrates the advantages that the cleaning granule 10 has over comparative granules with respect to cohesiveness, dissolution rate, detergency power/improvement, and/or other factors. With regards to the comparative granules shown in FIG. 6C, the following observations were made during testing:

Comparative Study 1a: due to insufficient total amount of surfactants, the cohesion of the comparative granule was insufficient, and the success rate of forming a spherical shape was poor.

Comparative Study 1b: even if a high amount of modifying agent was added, the formula remained wet and sticky, and the success rate of the granules being formed into a sphere was poor, most of which were flat and long.

Comparative Study 1c: although the total amount of surfactant increases, the A/B ratio was too low, resulting in insufficient cohesion of the granule.

Comparative Study 4a: if the A/B ratio was too high, the cohesive force of the granule would be too large, and it would not be easy to dissolve, resulting in a long dissolution time.

Comparative Study 13a: the total amount of surfactant was too high: the cohesive force of the granule was too large; the formula was too wet and sticky, and not easy to dissolve; the extrusion process was not smooth, the granule was mostly flat and long, and the dissolution time was long.

One method of using the cleaning granule according the present teachings may involve direct application of the granule to the object being cleaned. Alternatively, the granule may first be dissolved in water to form a cleaning solution, which is then applied to the object being cleaned.

The cleaning granule is further described with reference to the following additional examples, but it should be understood that these examples are for illustrative purposes only and should not be construed as limiting the implementation of the present teachings.

Inventive Example 1

The cleaning granule comprises and is formed by: 5 wt % sodium $C_{14}$~$C_{17}$ secondary alkyl sulfonate and 15 wt % sodium lauryl alcohol polyoxyethylene ether sulfate are mixed to obtain a first mixture; then, into the first mixture, 5 wt % glycerol, 1 wt % carboxymethyl cellulose, 0.3 wt % layered crystalline sodium disilicate, 0.001 wt % denatonium, and 20 wt % sodium bicarbonate (serving as disintegrant and alkaline agent), 52.699 wt % sodium sulfate, 0.5 wt % orange oil microcapsules, and 0.5 wt % protease, are added and mixed to obtain a cleaning composition. Next, the cleaning composition is molded and formed to have a diameter of 5 mm to 10 mm and cut to create cleaning granules or pellets.

Inventive Examples 2 to 8 and Comparative Examples 1 to 6

The Inventive Examples 2 to 8 and the Comparative Examples 1 to 6 were performed using the same steps as in the inventive example 1, except for the types and amounts of the ingredients shown in Table 1 below.

TABLE 1

| | | Inventive Examples | | | | | | | |
|---|---|---|---|---|---|---|---|---|---|
| | Unit: wt % | 1 | 2 | 3 | 4 | 5 | 6 | 7 | 8 |
| Cleaning Granules | Orange Oil Microcapsules | 0.5 | 0.5 | 0.5 | 0.5 | 0.5 | 0.5 | 0.5 | 0.5 |
| | Protease | 0.5 | 0.5 | 0.5 | 0.5 | 0.5 | 0.5 | 0.5 | 0.5 |
| | $C_{14}$~$C_{17}$ Alkyl Sulfonate | 5 | 5 | 8 | 10 | 10 | 15 | 18 | 5 |
| | Sodium Lauryl Alcohol Polyoxyethylene Ether Sulfate | 15 | 15 | 24 | 40 | 50 | 45 | 54 | 15 |
| | Total $C_{14}$~$C_{17}$ Alkyl Sulfonate & Sodium Lauryl Alcohol Polyoxyethylene Ether Sulfate | 20 | 20 | 30 | 50 | 60 | 60 | 72 | 20 |
| | Ratio of $C_{14}$~$C_{17}$ Alkyl Sulfonate to Sodium Lauryl Alcohol Polyoxyethylene Ether Sulfate | 1:3 | 1:3 | 1:3 | 1:4 | 1:5 | 1:3 | 1:3 | 1:3 |
| | Glycerin | 5 | 5 | 4 | 3 | 3 | 2 | 2 | 5 |
| | Carboxymethyl Cellulose | 1 | 2 | 1 | 1 | 1 | 2 | 2.5 | 0 |
| | Layered Crystalline Sodium Disilicate | 0.3 | 0.3 | 0.3 | 0.3 | 0.3 | 0.3 | 0.3 | 0.3 |
| | Sodium Bicarbonate | 20 | 20 | 20 | 20 | 20 | 20 | 20 | 20 |
| | Sodium Sulfate | 52.699 | 51.699 | 41.699 | 24.699 | 14.699 | 14.699 | 2.199 | 53.699 |
| | Denatonium | 0.001 | 0.001 | 0.001 | 0.001 | 0.001 | 0.001 | 0.001 | 0.001 |

TABLE 2

| | Unit: wt % | Comparative Examples 1 | 2 | 3 | 4 | 5 | 6 |
|---|---|---|---|---|---|---|---|
| Cleaning Granules | Orange Oil Microcapsules | 0.5 | 0.5 | 0.5 | 0.5 | 0.5 | 0.5 |
| | Protease | 0.5 | 0.5 | 0.5 | 0.5 | 0.5 | 0.5 |
| | $C_{14}$~$C_{17}$ Alkyl Sulfonate | 5 | 3 | 10 | 20 | 15 | 5 |
| | Sodium Lauryl Alcohol Polyoxyethylene Ether Sulfate | 15 | 12 | 20 | 40 | 5 | 15 |
| | Total $C_{14}$~$C_{17}$ Alkyl Sulfonate & Sodium Lauryl Alcohol Polyoxyethylene Ether Sulfate | 20 | 15 | 30 | 60 | 20 | 20 |
| | Ratio of $C_{14}$~$C_{17}$ Alkyl Sulfonate to Sodium Lauryl Alcohol Polyoxyethylene Ether Sulfate | 1:3 | 1:4 | 1:2 | 1:2 | 3:1 | 1:3 |
| | Glycerin | 0 | 5 | 4 | 1 | 5 | 5 |
| | Carboxymethyl Cellulose | 1 | 1 | 1 | 1 | 1 | 1 |
| | Layered Crystalline Sodium Disilicate | 0.3 | 0.3 | 0.3 | 0.3 | 0.3 | 0 |
| | Sodium Bicarbonate | 20 | 20 | 20 | 20 | 20 | 20 |
| | Sodium Sulfate | 57.699 | 57.699 | 43.699 | 16.699 | 52.699 | 52.999 |
| | Denatonium | 0.001 | 0.001 | 0.001 | 0.001 | 0.001 | 0.001 |

Evaluation/Test Items

Spherical Measurement: used a camera (e.g., Olympus Tough TG-6) and ImageJ software to measure the dimensions of the shortest side and longest side of Inventive Examples 1 to 8 and Comparative Example 6; thereafter, applied the short side and long side dimensions to the following formula to calculate the sphericity: sphericity=shortest side size/longest side size. Sphericity greater than 0.9 is a granular material that can be continuously rolled.

Measurement of particle size (unit: mm): used a digital thickness gauge (e.g., Mitutoyo) to measure particle size of Inventive Examples 1 to 12 and Comparative Example Studies 1a to 13a shown in FIGS. 6A-6C and Inventive Examples 1 to 8 and Comparative Example 6 shown in Tables 1-2 above.

Density Measurement (unit: g/L): calculated densities of Inventive Examples 1 to 8 and Comparative Example 6 of Tables 1-2 using their respective weight and volume.

Sphere Fluidity Measurement: observed the state of 2 kg of Inventive Examples 1 to 8 and Comparative Example 6 of Tables 1-2 through a conical funnel with a height of 15 cm, a volume of 500 ml, and an exit aperture of 5 cm, and measured the time to pass through the funnel.

Dissolution Time Measurement: 20 grams of Inventive Examples 1 to 12 and Comparative Example Studies 1a to 13a shown in FIGS. 6A-6C and Inventive Examples 1 to 8 and Comparative Example 6 of Tables 1-2 were placed in 60 liters of water, and then stirred with a rotation speed set at 200 rpm and temperature set at 25° C., and the time for complete dissolution was recorded.

Cleaning Power Test: the standard test for measuring the stain-removing ability of artificially contaminated fabrics (not suitable for detergent grades) was performed according to ASTM D3050-07 (2015), and the measurement was performed under the same usage amount of each inventive example and comparative example. It should be noted that although Comparative Examples 1a to 13a of FIG. 6C and Comparative Examples 2 to 5 of Table 2 are not granular, their cleaning power can still be measured.

Fragrance Persistence Measurement (unit: week): Inventive Examples 1 to 8 and Comparative Example 6 of Tables 1-2 were placed in a 25° C. environment for 4 hours, and then placed in an environment with a temperature set at 45° C. The fragrance evaluation was performed by 20 reviewers each week, and 80% of the reviewers agreed that when they smelled the scent, it was judged to be scented and lasted for at least 12 weeks.

TABLE 3

| | | Inventive Examples 1 | 2 | 3 | 4 | 5 | 6 | 7 |
|---|---|---|---|---|---|---|---|---|
| Evaluation Test | Complete Dissolution Time (Seconds) | 270 | 210 | 270 | 305 | 305 | 225 | 195 |
| | Extruded Through an Extrusion Hole | Continuous Output of Bars | | | | | | |
| | Sphericity | 0.95 | 0.95 | 0.95 | 0.95 | 0.98 | 0.98 | 0.98 |
| | Sphere Fluidity | Scrolls Smoothly and Passes Through the Exit of the Conical Funnel for More Than 1 Minute | | | | | | |
| | Particle Size (mm) | 6 | 6 | 6 | 6 | 6 | 6 | 6 |
| | Density (g/L) | >1500 | >1500 | >1500 | >1500 | >1500 | >1500 | >1500 |
| | Color Difference After Washing Fabric | 5 | 7 | 8 | 9 | 12 | 13 | 14 |
| | Fragrance Persistence (Week) | >12 | >12 | >12 | >12 | >12 | >12 | >12 |

TABLE 4

| | | Comparative Examples | | | | | |
|---|---|---|---|---|---|---|---|
| | | 1 | 2 | 3 | 4 | 5 | 6 |
| Evaluation Test | Complete Dissolution Time (Seconds) | X | X | X | X | X | 270 |
| | Extruded Through an Extrusion Hole | Unable to Continuously Output Bars Due to Lack of Elasticity | Inability to Output Sticks or Cut Out Pellets Continuously Due to Stickiness or Fragility | | | | Continuous Output of Bars |
| | Sphericity | X | X | X | X | X | 0.09 |
| | Sphere Fluidity | X | X | X | X | X | The Particles are Agglomerated and Sticky to Each Other, Blocking the Exit of the Conical Funnel |
| | Particle Size (mm) | X | X | X | X | X | 6 |
| | Density (g/L) | X | X | X | X | X | >1500 |
| | Color Difference After Washing Fabric | N/A | 3.3 | 8 | 14 | 5 | 4 |
| | Fragrance Persistence (Week) | X | X | X | X | X | >12 |

X indicates that no Granules were Produced and Could Not be Measured
N/A Means not Measured From the experimental data in Tables 2 and 4, it can be seen that, in Comparative Example 1, no molding agent was used, causing the cleaning composition to be compacted into hard pieces without elasticity. As a result, ejection of the composition through the output hole of a molding device was difficult, and cleaning pellets could not be obtained. From the experimental data in Tables 2 and 4, it can be seen that in Comparative Examples 2 to 5, the total amount of sulfonate and fatty alcohol-based sulfate was less than 20 wt % or the ratio of the sulfonate to the fatty alcohol-based sulfate is outside the range of 1:3 to 1:5. As a result, the components of the cleaning composition of Comparative Examples 2 to 5 do not easily agglomerate, and it is impossible to obtain a cleaning granule. In Comparative Example 6, no anti-sticking agent was used and the fluidity of the spheres was bad, which meant that the cleaning granule would still stick to other granules and adversely agglomerate during storage.

From the experimental data in Tables 1 and 3, it can be seen that the Inventive Examples 1 to 8, by way of including the molding agent, controlling the total range of sulfonate and fatty alcohol sulfate to be greater than 15 wt % and less than 100 wt %, and having a ratio of sulfonate to fatty alcohol-based sulfate between 0.2 and 0.4, it is possible to advantageously obtain an agglomerated cleaning granule. In addition, referring to the experimental data of the spheres, it can be seen that the cleaning granule of the present teachings has excellent fluidity, which means that with the inclusion of the anti-sticking agent component, the cleaning granule will not clump to other granules and agglomerate during storage. Referring to the experimental data of the dissolution rate, it can be seen that the granule has the characteristics of rapid dissolution with the inclusion of the disintegrant.

In summary, through the combination of the anionic surfactant component, the anti-sticking agent component, and the molding agent, as well as the particular content of the anionic surfactant component, an agglomerated cleaning granule that is non-sticking and has good fluidity may be achieved. The cleaning granule according to the present teachings will not stick to and agglomerate with other granules during the storage process. It can be quickly dissolved during use and has high cleaning power. Therefore, it can indeed achieve purposes of the present teachings.

It should be understood to a person of ordinary skill in the art that different configurations of the solid granule are possible. For example, the arrangement and order of the components of the solid granule may differ from those described in the above written description and figures without departing from the scope and spirit of the present teachings. The components included in the solid granule may also differ from those described in the above written description and figures without departing from the scope and spirit of the present teachings.

While the present teachings have been described above in terms of specific embodiments, it is to be understood that they are not limited to those disclosed embodiments. Many modifications and other embodiments will come to mind to those skilled in the art to which this pertains, and which are intended to be and are covered by both this disclosure and the appended claims. For example, in some instances, one or more features disclosed in connection with one embodiment can be used alone or in combination with one or more features of one or more other embodiments. It is intended that the scope of the present teachings should be determined by proper interpretation and construction of any claims and their legal equivalents, as understood by those of skill in the art relying upon the disclosure in this specification and the attached drawings.

What is claimed is:

1. A solid granule for use as or in a cleaning agent, comprising:

an anionic surfactant component having at least one anionic sulfonate surfactant and at least one anionic fatty alcohol-based sulfate surfactant, wherein a combined amount of said sulfonate surfactant and said sulfate surfactant is between 15.0 wt % and 100 wt % based on a total amount of the solid granule being 100 wt %; and a granule-forming agent in an amount of 5.0 wt % or less;

wherein a ratio of the amount of said sulfonate surfactant to the amount of said sulfate surfactant is between 0.20 and 0.75;

wherein a cohesion of the solid granule is between 1000 g/mm and 4000 g/mm; and wherein a particle size of the granule is greater than or equal to 3.0 mm and less than or equal to 20.0 mm.

2. The solid granule according to claim 1, wherein the combined amount of said sulfonate surfactant and said sulfate surfactant is between 18.0 wt % and 60.0 wt %.

3. The solid granule according to claim 1, wherein the amount of said sulfate surfactant is between 15.0 wt % and 60.0 wt % based on the total amount of the solid granule being 100 wt %.

4. The solid granule according to claim 1, wherein the amount of said sulfonate surfactant is between 3.0 wt % and 25.0 wt % based on the total amount of the solid granule being 100 wt %.

5. The solid granule according to claim 1, further comprising an anti-sticky agent, wherein said anti-sticking agent comprises a layered sodium disilicate and/or zeolite.

6. The solid granule according to claim 1, wherein a particle size of the granule is greater than or equal to 6.0 mm and less than or equal to 20.0 mm.

7. The solid granule according to claim 1, wherein complete dissolution of the solid granule occurs in approximately 6 minutes or less.

8. The solid granule according to claim 1, wherein the combined amount of said sulfonate surfactant and said sulfate surfactant is between 20.0 wt % and 30.0 wt %, and wherein the amount of said granule-forming agent is between 3.0 wt % and 4.0 wt %.

9. The solid granule according to claim 1, wherein the combined amount of said sulfonate surfactant and said sulfate surfactant is between 30.0 wt % and 40.0 wt %, and wherein the amount of said granule-forming agent is between 2.0 wt % and 3.0 wt %.

10. The solid granule according to claim 1, wherein the combined amount of said sulfonate surfactant and said sulfate surfactant is greater than or equal to 40.0 wt %, and wherein the amount of said granule-forming agent is less than or equal to 2.0 wt %.

11. The solid granule according to claim 1, wherein said sulfate surfactant comprises an alkyl sulfate or alkyl ester sulfate surfactant.

12. The solid granule according to claim 1, wherein said anionic sulfonate surfactant comprises alkoxylated sulfonate or alkyl ester sulfonate surfactant.

13. The solid granule according to claim 1, wherein said granule-forming agent is a polyol agent.

14. The solid granule according to claim 1, wherein said granule-forming agent includes at least one of glycerin, propylene glycol, or sorbitol.

15. The solid granule according to claim 1, further comprising a disintegrant configured to dissolve the granule upon contact with moisture, said disintegrant includes carboxymethyl cellulose, tartaric acid, and/or citric acid.

16. The solid granule according to claim 1, further comprising a fragrance component configured to provide a scent to the granule, wherein the fragrance component is an essential oil.

17. The solid granule according to claim 1, further comprising an enzyme component configured to increase a cleaning power of the granule, wherein the enzyme component includes at least one of protease, lipase, cellulase, amylase, mannanase, or pectinase.

18. The solid granule according to claim 1, further comprising an alkali agent configured to remove greasy soil and/or neutralize acidic soil.

19. The solid granule according to claim 18, wherein the alkali agent includes sodium sulfate and/or sodium bicarbonate.

20. The solid granule according to claim 1, further comprising a chelating agent.

21. The solid granule according to claim 1, further comprising a bittering agent.

22. A solid granule for use as or in a cleaning agent, comprising:

an anionic surfactant component having at least one anionic sulfonate surfactant and at least one anionic fatty alcohol-based sulfate surfactant, wherein a combined amount of said sulfonate surfactant and said sulfate surfactant is between 18.0 wt % and 60.0 wt % based on a total amount of the solid granule being 100 wt %; and a granule-forming agent in an amount of 5.0 wt % or less;

wherein a ratio of the amount of said sulfonate surfactant to the amount of said sulfate surfactant is between 0.20 and 0.75;

wherein said ratio, said combined amount, and said amount of the granule-forming agent provide a formulation that produces cohesion in the granule between 1000 g/mm and 4000 g/mm;

wherein the granule has a spherical shape defined with a sphericity of at least 0.95; and wherein a particle size of the granule is greater than or equal to 3.0 mm and less than or equal to 20.0 mm.

23. The solid granule according to claim 22, wherein:

said sulfonate surfactant comprises a $C_{14}$-$C_{17}$ secondary alkyl sulfonate and/or methyl ester sulfonate;

said sulfate surfactant comprises sodium laureth sulfate; and said granule-forming agent comprises glycerin, sorbitol, and/or propylene glycol.

24. The solid granule according to claim 22, wherein said formulation provides complete dissolution of the granule in approximately 6 minutes or less.

25. The solid granule according to claim 22, wherein no anti-sticking agent is contained in the granule.

26. A detergent comprising:

a plurality of solid granules, wherein each solid granule includes:

an anionic surfactant component having at least one anionic sulfonate surfactant and at least one anionic fatty alcohol-based sulfate surfactant, wherein a combined amount of said sulfonate surfactant and said sulfate surfactant is between 15.0 wt % and 100 wt % based on a total amount of the solid granule being 100 wt %; and a granule-forming agent;

wherein a ratio of the amount of said sulfonate surfactant to the amount of said sulfate surfactant is between 0.20 and 0.75;

wherein a cohesion of each solid granule is between 1000 g/mm and 4000 g/mm; and wherein a particle size of the granule is greater than or equal to 3.0 mm and less than or equal to 20.0 mm.

27. The detergent according to claim 26, wherein the solid granules have a substantially spherical shape.

28. The detergent according to claim 27, wherein the substantially spherical shape of the solid granules is defined with a sphericity of at least 0.95.

29. The detergent according to claim 26, wherein the solid granules have a uniform size, and the uniform size of the solid granules is greater than or equal to 6 mm and less than or equal to 20 mm.

30. The detergent according to claim 26, wherein at least a portion of the solid granules each include a supplemental ingredient coated as an outer layer.

* * * * *